US007019634B2

(12) United States Patent
Bissett et al.

(10) Patent No.: US 7,019,634 B2
(45) Date of Patent: Mar. 28, 2006

(54) ADDRESSABLE LOCATION INDICATOR APPARATUS AND METHOD

(76) Inventors: Brian David Bissett, 54 Rope Ferry Rd., Apt B-26, Waterford, CT (US) 06385-2822; John Vasilchik, 121 Wilson Ave., Endwell, NY (US) 13760

( * ) Notice: Subject to any disclaimer, the term of this patent is extended or adjusted under 35 U.S.C. 154(b) by 244 days.

(21) Appl. No.: 10/708,395

(22) Filed: Feb. 28, 2004

(65) Prior Publication Data

US 2005/0190052 A1 Sep. 1, 2005

(51) Int. Cl.
*G08B 29/00* (2006.01)

(52) U.S. Cl. ..... 340/506; 340/531

(58) Field of Classification Search ..... 340/506, 340/507, 508, 539.1, 531
See application file for complete search history.

(56) References Cited

U.S. PATENT DOCUMENTS 4,228,424 A * 10/1980 Le Nay et al. ..... 340/506
6,756,896 B1 * 6/2004 Ford ..... 340/506
6,930,599 B1 * 8/2005 Naidoo et al. ..... 340/539.1
6,975,220 B1 * 12/2005 Foodman et al. ..... 340/531

* cited by examiner

*Primary Examiner*—John Tweel, Jr.

(57) ABSTRACT

An addressable location indicator apparatus and method for residential, commercial, and business locations which is capable of both local and remote activation, is disclosed. In the preferred embodiment, the addressable location indicator apparatus concerns three electronic units: a decoder activation unit, a location indicator unit, and a remote activation unit. The three electronic units in the addressable location indicator apparatus function in unison to accomplish the addressable location indication method. The interaction between the three electronic units in the addressable location indicator apparatus and the methodology employed to accomplish the location indication method are also disclosed.

18 Claims, 10 Drawing Sheets

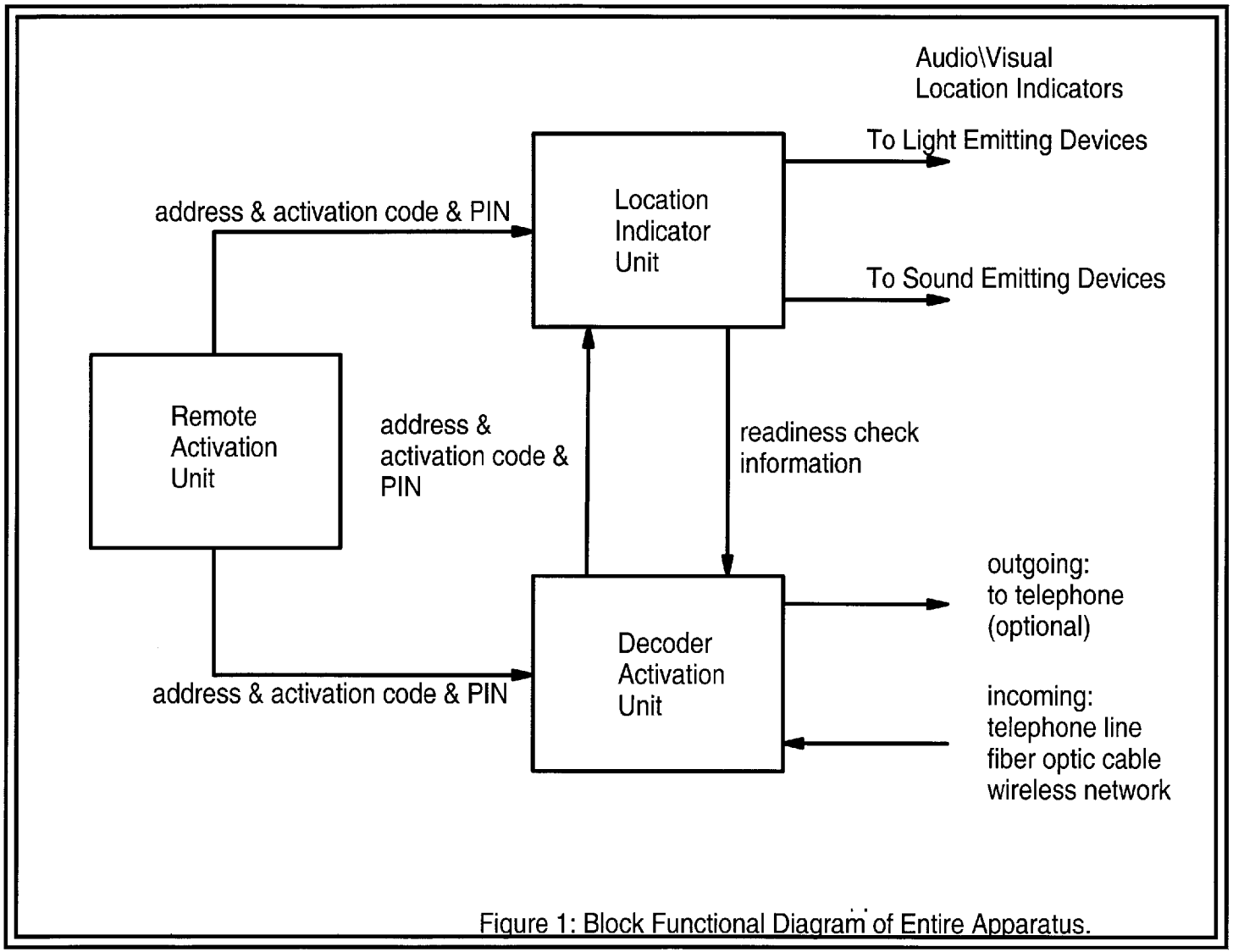
Figure 1: Block Functional Diagram of Entire Apparatus.

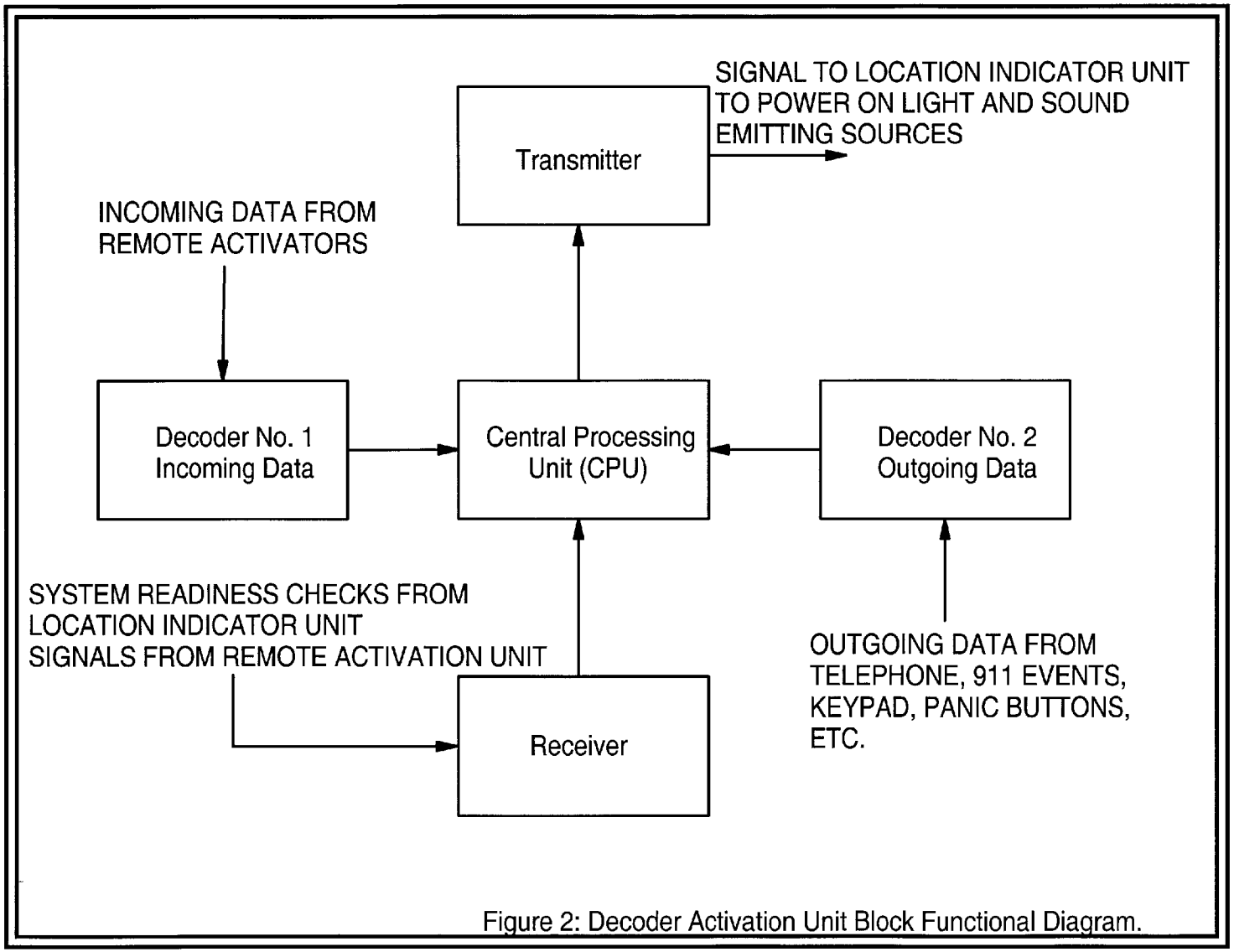
Figure 2: Decoder Activation Unit Block Functional Diagram.

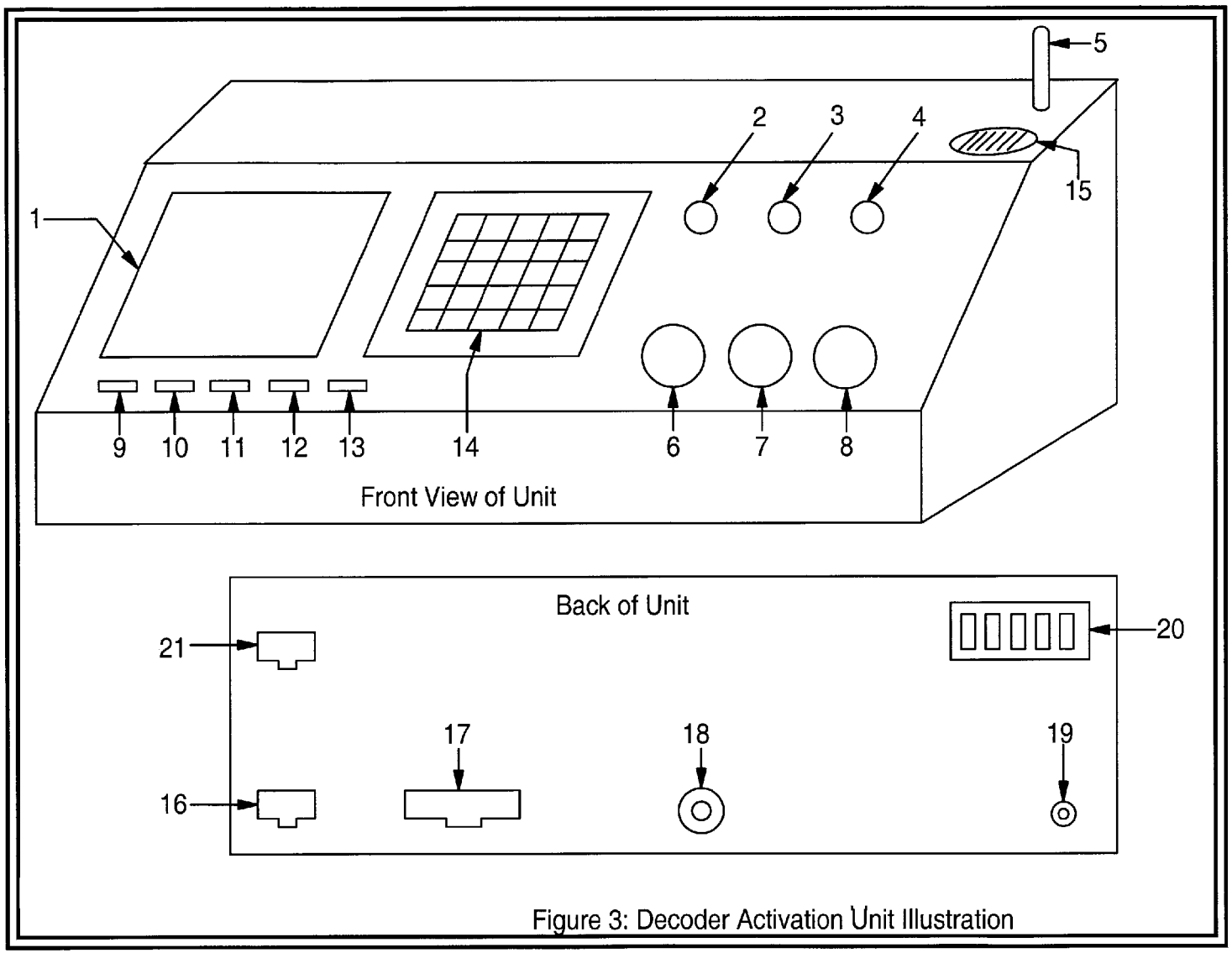
Figure 3: Decoder Activation Unit Illustration

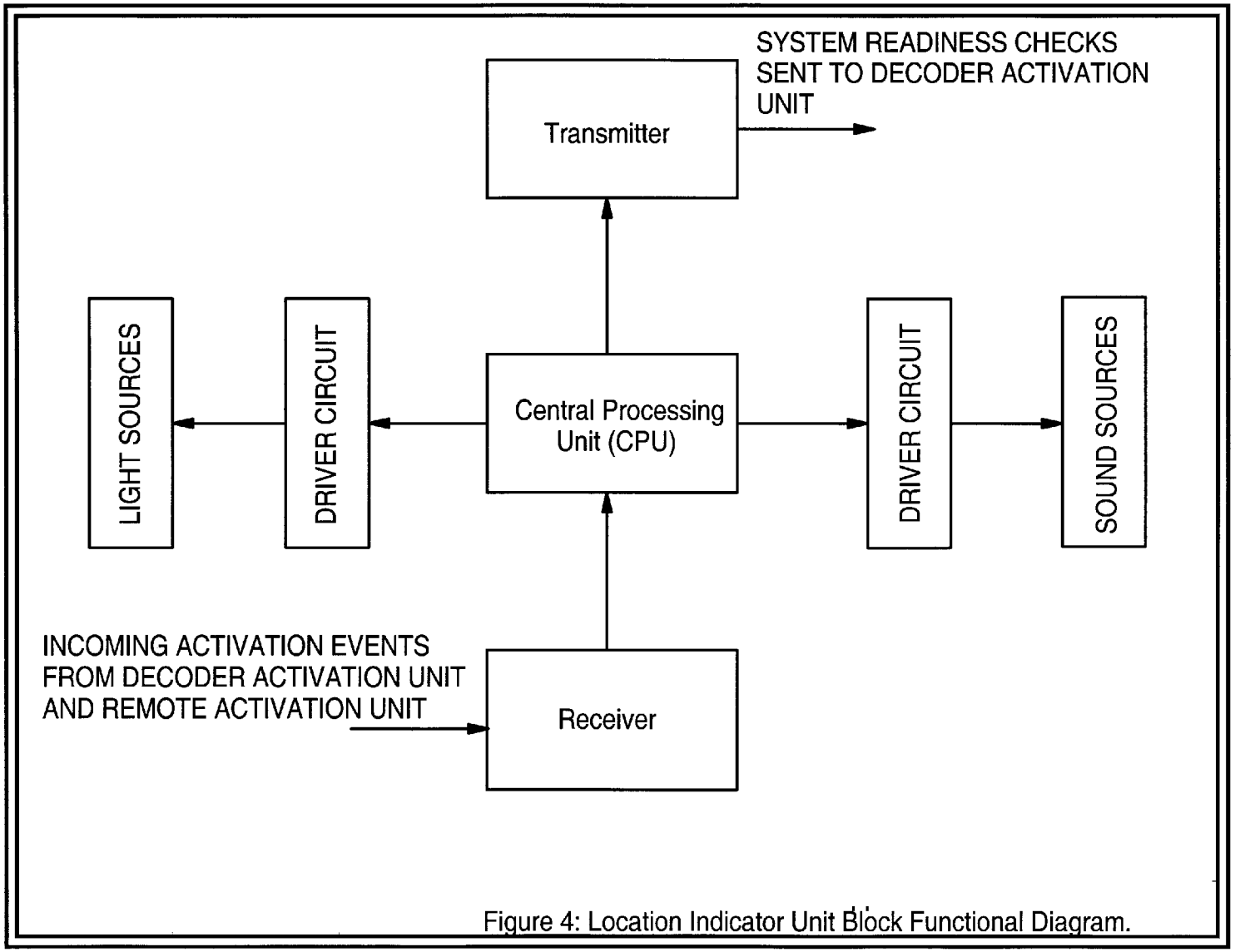
Figure 4: Location Indicator Unit Block Functional Diagram.

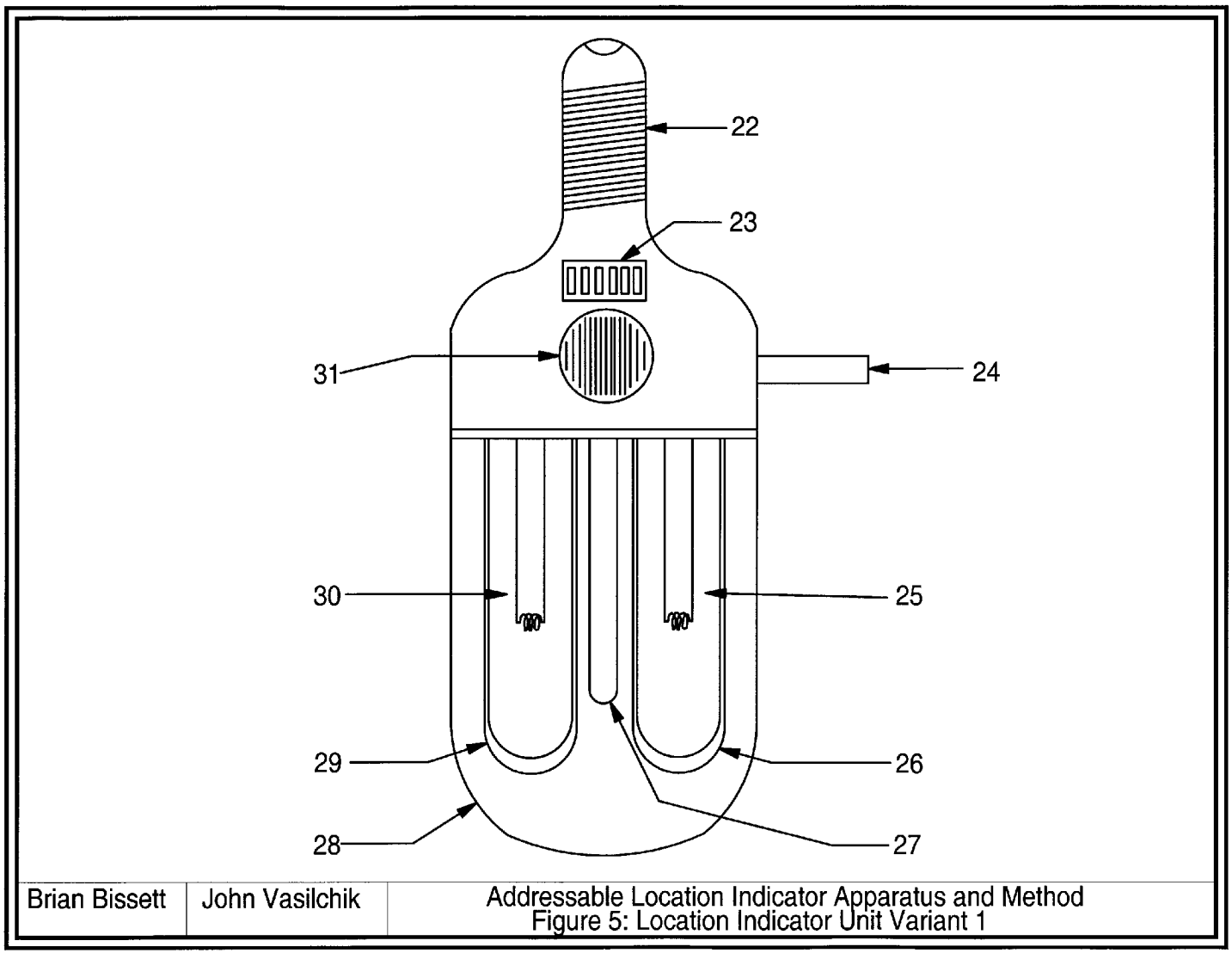
22
23
24
25
26
27
28
29
30
31
Brian Bissett
John Vasilchik
Addressable Location Indicator Apparatus and Method
Figure 5: Location Indicator Unit Variant 1

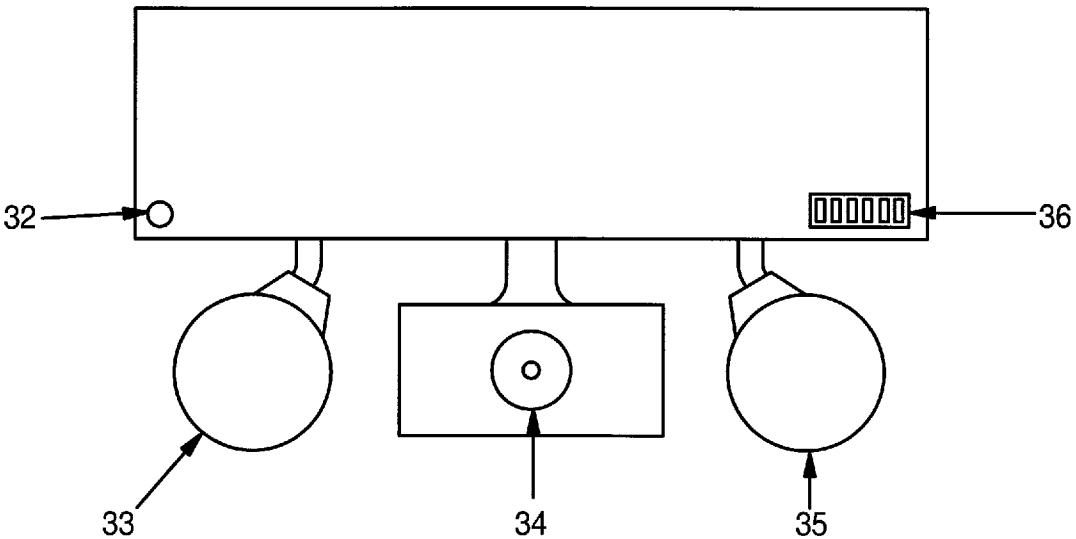
Figure 6: Location Indicator Unit Variant 2

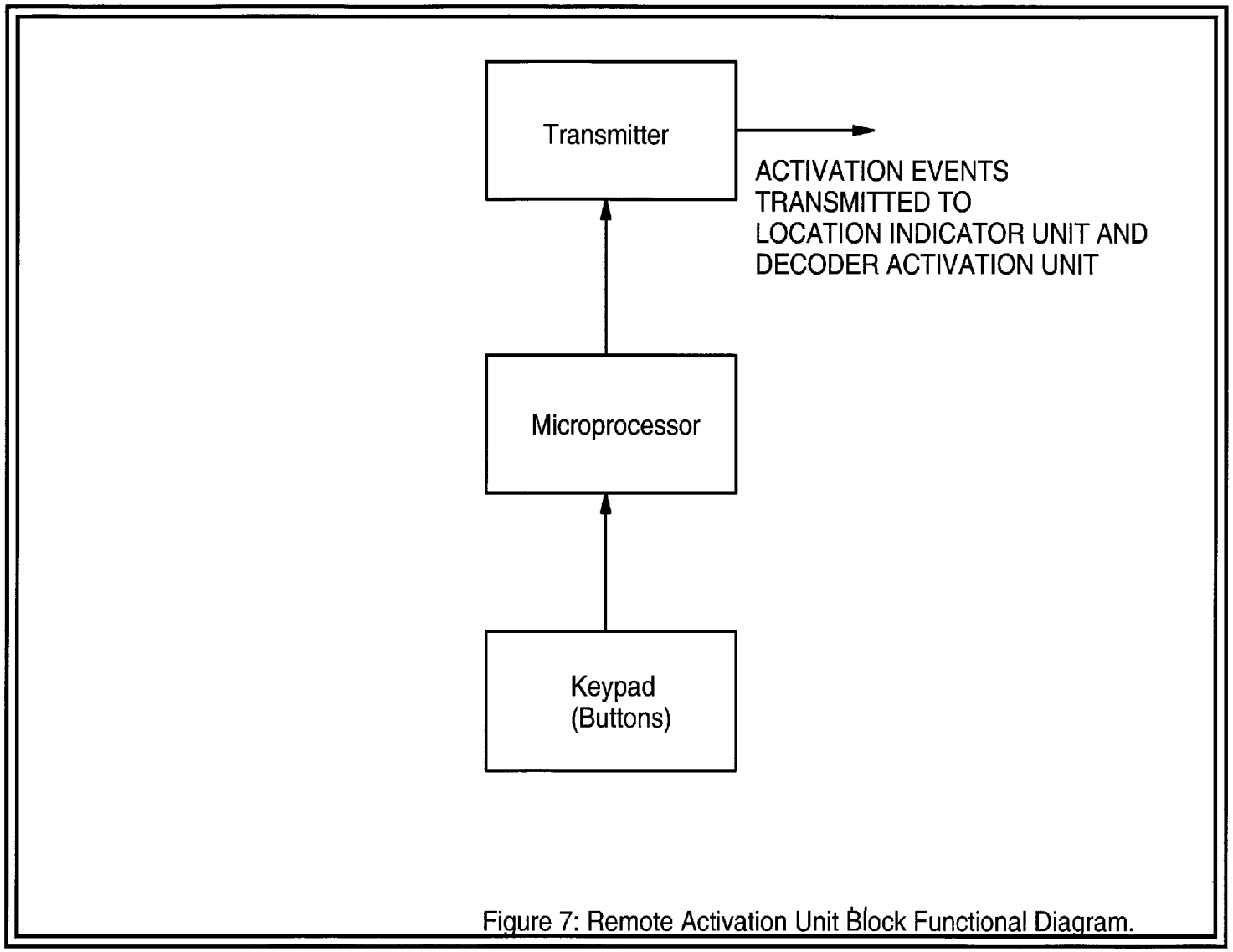
Figure 7: Remote Activation Unit Block Functional Diagram.

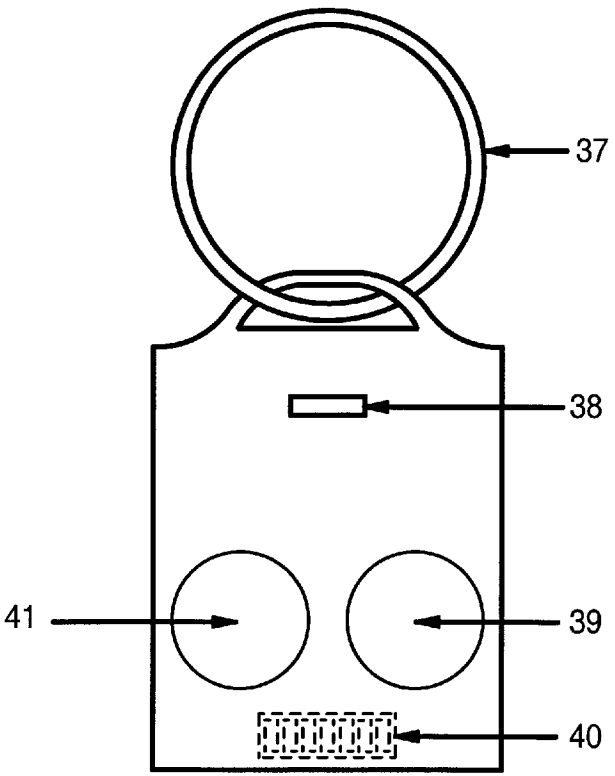
Figure 8: Remote Activation Unit Variant 1

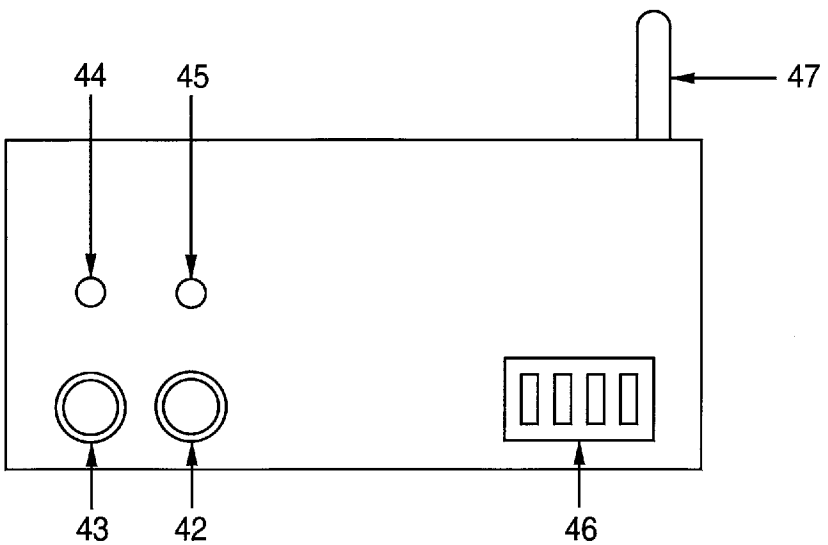
Figure 9: Remote Activation Unit Variant 2

| Description of Activation Event | | Units Utilized for Activation Event | | | | | |
|---|---|---|---|---|---|---|---|
| | | Decoder Activation Unit | | Location Indicator Unit | | Remote Activation Unit | |
| | | Utilized | Trigger | Utilized | Trigger | Utilized | Trigger |
| 10-1 | 911 event | Yes | Yes | Yes | No | No | No |
| 10-2 | authorized activator event | Yes | Yes | Yes | No | No | No |
| 10-3 | programmed number activation event | Yes | Yes | Yes | No | No | No |
| 10-4 | remote activation event | Yes | Possibly | Yes | No | Possibly | Possibly |
| 10-5 | manual activation event | Yes | Possibly | Yes | No | Possibly | Possibly |
| 10-6 | medical event | Yes | Possibly | Yes | No | Possibly | Possibly |
| 10-7 | fire event | Yes | Possibly | Yes | No | Possibly | Possibly |
| 10-8 | public safety event | Yes | Possibly | Yes | No | Possibly | Possibly |

FIGURE 10

ADDRESSABLE LOCATION INDICATOR APPARATUS AND METHOD

BACKGROUND OF INVENTION

Inventors: (1) Brian D Bissett 54 Rope Ferry Road Apt B-26 Waterford Conn. 06385-2822 Telephone 860 447 2421 Citizen of US: (2) John Vasilchik 121 Wilson Ave Endwell N.Y. 13760.

This invention concerns an addressable location indicator apparatus for residential, commercial, and business locations, and more specifically, an addressable location indicator that uses two means of activation, local activation and remote activation. In the preferred embodiment, the invention concerns three electronic units which function in unison to accomplish the addressable location indication method. The first electronic unit is termed a decoder activation unit, which is plugged into a residential, commercial, or business telephone line, wireless network, fiber optic cable, fiber optic network, or other communication network. The decoder activation unit has the ability to have a telephone connected to itself. The second electronic unit is termed the location indicator unit, which has two variants. The first variant of the location indicator unit screws into an existing light bulb socket or plugs into an existing electric wall socket, and is tailored toward aftermarket addition. The second variant of the location indicator unit is meant to be directly wired into a building's electrical system and is more tailored toward installation during construction. The location indicator unit is designed to be placed prominently on the exterior of the building or structure in which the decoder activation unit is installed. The third electronic unit is termed the remote activation unit, which has two variants. The first variant of the remote activation unit is designed to be placed on a key chain or otherwise carried in a portable manner. The second variant of the remote activation unit is designed to be permanently installed within the same structure as the decoder activation unit. Additionally, the invention concerns colored, clear, and white light emitting sources, colored glass, sound emitting sources, decoding units for incoming and outgoing telephone communications (calls), a central processing unit, and transmitter receiver pairs for communication between the decoder activation unit, the location indicator unit, and the remote activation unit.

Unfortunately, determining the location of a particular address can be time consuming for emergency personnel. The ease of which address locations can be identified varies regionally depending upon factors such as inconsistent street numbering, vandalism, illegible street or apartment numbers, poor contrast of address location specifiers, and unlabeled address locations. In short, there is not currently a satisfactory method that allows emergency personnel to rapidly and accurately find the address of a particular location. Accordingly, the need exists for such a method and apparatus which allows rapid determination of the proper address for life threatening emergencies and events. The need is increasing and becoming more urgent as both the elderly populations and single parent populations throughout the world are rising.

SUMMARY OF INVENTION

An invention that satisfies those needs and provides still other benefits that will be apparent to those skilled in the art has now been developed. Broadly speaking, in one aspect this invention concerns an addressable location indicator apparatus for indicating the street address of a residential, commercial, or business location, the apparatus comprising:

(a) a decoder activation unit which is connected to a residential, commercial, or business telephone line, wireless network, fiber optic network, or other communication network. The decoder activation unit monitors outgoing communications (or calls), incoming communications (or calls), and is capable of activating the location indicator unit in the addressable location indicator apparatus whenever an activation event occurs. The decoder activation unit is also capable of dialing a set of preprogrammed telephone numbers over a residential, commercial, or business telephone line, wireless network, fiber optic network, or other communication network whenever an activation event occurs.

(b) a location indicator unit, which is capable of attracting attention by controlling light emitting sources (such as light bulbs, LED's, and other such devices known to those skilled in the art) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

The decoder activation unit, location indicator unit, and remote activation unit together comprise the addressable location indicator apparatus, and communicate as a system to accomplish the addressable location indicator method.

In another aspect, the invention concerns an addressable location indicator apparatus for indicating the street address of a residential, commercial, or business location, which is activated locally by a 911 event. The apparatus comprising:

(a) a decoder activation unit which is connected to a residential, commercial, or business telephone line, wireless network, fiber optic network, or other communication network. The decoder activation unit monitors outgoing communications (or calls) and activates the location indicator unit of the addressable location indicator apparatus when a 911 event occurs on a residential, commercial, or business telephone line, wireless network, fiber optic network, or other communication network to which the decoder activation unit in the addressable location indicator apparatus is connected to.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

In another aspect, the invention concerns an addressable location indicator apparatus for indicating the street address of a residential, commercial, or business location, which is activated locally by a programmed number activation event. The apparatus comprising:

(a) a decoder activation unit which is connected to a residential, commercial, or business telephone line, wireless network, fiber optic network, or other communication network. The decoder activation unit monitors outgoing communications (or calls) and activates the location indicator unit of the addressable location indicator apparatus when a programmed number activation event occurs on a residential, commercial, or business telephone line, wireless network, fiber optic network, or other communication network to which the decoder activation unit in the addressable location indicator apparatus is connected to.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

In another aspect, the invention concerns an addressable location indicator apparatus for indicating the street address of a residential, commercial, or business location, which is activated remotely by an authorized activator. The apparatus comprising:

(a) a decoder activation unit which is connected to a residential, commercial, or business telephone line, wireless network, fiber optic network, or other communication network. The decoder activation unit monitors incoming communications (or calls) on a residential, commercial, or business telephone line, wireless network, fiber optic network, or other communication network and activates the location indicator unit of the addressable location indicator apparatus when an authorized activator triggers an activation event remotely over a residential, commercial, or business telephone line, wireless network, fiber optic network, or other communication network to which the decoder activation unit in the addressable location indicator apparatus is connected to.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

In another aspect, the invention concerns an addressable location indicator apparatus for indicating the street address of a residential, commercial, or business location, which is activated remotely by a remote activation unit. The apparatus comprising:

(a) a decoder activation unit which is connected to a residential, commercial, or business telephone line, wireless network, fiber optic network, or other communication network. The decoder activation unit monitors outgoing and incoming communications (or calls) and is capable of activating the location indicator unit in the addressable location indicator apparatus whenever an activation event occurs. The decoder activation unit is also capable of dialing a set of preprogrammed telephone numbers over a residential, commercial, or business telephone line, wireless network, fiber optic network, or other communication network whenever an activation event occurs.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event. In the event of a remote activation event, the remote activation unit will activate the location indicator unit of the addressable location indicator apparatus and trigger the decoder activation unit of the addressable location indicator apparatus to dial a preprogrammed series of telephone numbers depending upon the activation code within the activation command sent by the remote activation unit over a residential, commercial, or business telephone line, wireless network, fiber optic network, or other communication network.

In another aspect, the invention concerns an addressable location indicator apparatus for indicating the street address of a residential, commercial, or business location, which is activated manually by means of some physical or electrical trigger on the remote activation unit or the decoder activation unit. The apparatus comprising:

(a) a decoder activation unit which is connected to a residential, commercial, or business telephone line, wireless network, fiber optic network, or other communication network. The decoder activation unit monitors outgoing and incoming communications (or calls) and is capable of activating the location indicator unit in the addressable location indicator apparatus whenever an activation event occurs. The decoder activation unit is also capable of dialing a set of preprogrammed telephone numbers over a residential, commercial, or business telephone line, wireless network, fiber optic network, or other communication network whenever an activation event occurs. The decoder activation unit is also capable of triggering an activation event manually by means of a physical trigger (such as a button on the unit) or by means of an electrical trigger (such as a sensor).

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event. In the event of a remote activation event, the remote activation unit will activate the location indicator unit of the addressable location indicator apparatus and trigger the decoder activation unit of the addressable location indicator apparatus to dial a preprogrammed series of telephone numbers depending upon the activation code within the activation command sent by the remote activation unit over a residential, commercial, or business telephone line, wireless network, fiber optic network, or other communication network. The remote activation unit is capable of triggering an activation event manually by means of a physical trigger (such as a button on the unit) or by means of an electrical trigger (such as a sensor).

"activation event" refers to the activation of the location indicator unit in the addressable location indicator apparatus by the decoder activation unit, remote activation unit, authorized activator, 911 event, programmed number activation event, authorized activator event, medical event, fire event, public safety event, or any other activation means be it local or remote.

"activation command" refers to a command sent remotely or locally from an authorized activator in the form of a numeric data frame which triggers activation of the addressable location indicator apparatus. Each activation command has embedded within it an activation code or codes which determine how the addressable location indicator apparatus will operate upon activation.

"personal identification number" (PIN) refers to a set of alphabetical and/or numerical digits utilized for the purpose of confirming the identity of an authorized activator, or to confirm that a transmission made from a remote activation unit, decoder activation unit, or location indicator unit is from a unit contained within the addressable location indicator apparatus installed at the given location.

"authorized activator" refers to any individual, business, or government agency which is authorized to remotely activate addressable location indicator.

"central processing unit" (CPU) refers to a micro computer or microprocessor utilized for generating numeric data frames, running algorithms, dialing telephone numbers, running system checks, generating sonic or blink events, or any of the other tasks required in the units making up an addressable location indicator apparatus.

LED light emitting diode.

LCD liquid crystal display.

"911 event" refers to the dialing of the digits 911 on a residential, commercial, or business telephone line on a hard line (conventional wire cable or fiber optic cable or network),or wireless network.

"authorized activator event" refers to the activation of the location indicator unit in the addressable location indicator system by any individual, business, or government agency which is authorized to remotely activate addressable location indicator.

"programmed number activation event" refers to the activation of the location indicator unit in the addressable location indicator system when any of the telephone numbers programmed into the central processing unit of the decoder activation unit are dialed or received from the telephone line or wireless network to which the decoder activation unit is connected.

"local activation" or "local activation event" refers to the activation of the addressable location indicator apparatus (or the triggering of an activation event in the addressable location indicator apparatus) by means of the decoder activation unit, the remote activation unit, or by any means from within the dwelling in which the addressable location indicator apparatus is installed.

"remote activation" or "remote activation event" refers to the activation of the addressable location indicator apparatus (or the triggering of an activation event in the addressable location indicator apparatus) from any location other than which the addressable location indicator apparatus is installed in by an authorized activator, or by means of a remote activation unit.

"manual activation event" refers to the remote activation of the location indicator unit and decoder activation unit in the addressable location indicator system manually by means of the remote activation unit or the decoder activation unit.

"medical event" refers to an emergency situation when an ambulance or paramedics are required to find a residential, commercial, or business location.

"fire event" refers to an emergency situation in which the fire department must find a residential, commercial, or business location.

"public safety event" refers to an emergency situation in which the public safety (police) department must find a residential, commercial, or business location.

"numeric data frame" refers to the transmission of digital or analog information in such a manner that the information transmitted is encoded within a recognizable boundary or boundaries which enable such information to be readily decoded and extracted.

"valid activation frame" refers to the transmission of digital or analog information which is capable of triggering an activation event in the decoder activation unit and/or location indicator unit in the addressable location indicator apparatus.

"activation code" refers to a numeric data frame which contains information for the location indicator unit as to the type of blink event and sonic event that should be utilized by the location indicator unit, and the telephone numbers to be automatically dialed by the decoder activation unit over a residential, commercial, or business telephone line on a hard line or wireless network.

"blink event" refers to the emission of light from the location indicator unit in such a fashion that is irregular or abnormal when compared to normal steady state lighting (such as blinking, flashing coded mnemonics such as "SOS", or any of an infinite variety of on/off duty cycles). This invention incorporates many such blink events, and the blink event to be utilized by the location indicator unit upon an activation event is determined by reading the activation code contained within the activation command of a numeric data frame.

"sonic event" refers to the emission of sound or noise from the location indicator unit in such a fashion that is distinctive as compared to background noise (such as siren type noises or other types of sounds operating on a regular or irregular type of duty cycle). This invention incorporates many such sonic events, and the sonic event to be utilized by the location indicator unit upon an activation event is determined by reading the activation code contained within the activation command of a numeric data frame.

"indicating the street address" or "indicating location" refers to the ability of the addressable location indicator apparatus to draw attention to or indicate a location by means of audio and visual cues such as blink events and sonic events.

BRIEF DESCRIPTION OF DRAWINGS

To facilitate further discussion of the invention, the following drawings are provided in which:

FIG. 1 illustrates a block functional diagram of the preferred embodiment of addressable location indicator which is principally comprised of a decoder activation unit, location indicator unit, and remote activation unit.

FIG. 2 illustrates a block functional diagram of the decoder activation unit.

FIG. 3 is an illustration of the decoder activation unit.

FIG. 4 illustrates a block functional diagram of the location indicator unit.

FIG. 5 is an illustration of the first variant of the location indicator unit.

FIG. 6 is an illustration of the second variant of the location indicator unit.

FIG. 7 illustrates a block functional diagram of the remote activation unit.

FIG. 8 is an illustration of the first variant of the remote activation unit.

FIG. 9 is an illustration of the second variant of the remote activation unit.

FIG. 10 is an illustration of various activation methods.

DETAILED DESCRIPTION

The present invention provides an apparatus that can indicate the location of a residential, commercial, or business street address by means of several methods which will be readily apparent to those skilled in the art. In the preferred embodiment, the addressable location indicator apparatus comprises three units, a decoder activation unit, a location indicator unit, and a remote activation unit. The three units communicate with each other to create a system capable of performing the addressable location indication method. One skilled in the art will recognize that a variety of schemes could be implemented with differently named building blocks utilizing a similar functionality to accomplish the same addressable location indication method as described here.

A block functional diagram of the addressable location indicator apparatus is shown in FIG. 1. The decoder activation unit is the communications hub of the system. It is the decoder activation unit that is connected to some form of communication network such as a residential, commercial, or business telephone line, wireless network, or fiber optic cable or network. As depicted in FIG. 1, all communications to and from the addressable location indicator apparatus by means of a communication network are monitored utilizing the decoder activation unit. In the preferred embodiment the decoder activation unit is responsible for directing operations within the addressable location indicator apparatus. Activation of the addressable location indicator apparatus and such tasks as system readiness tests are all accomplished within the decoder activation unit. The location indicator unit functions primarily to activate the location indication devices in the addressable location indicator apparatus on the exterior of the structure in which the addressable location indicator apparatus is installed. The location indicator unit is capable of performing system checks on itself to determine the readiness of the light emitting devices and sound emitting devices built into the location indicator unit. The results of these system readiness checks are then transmitted back to the decoder activation unit. The remote activation unit(s) serve only to trigger activation events in the addressable location indicator apparatus. Its communications are unidirectional to either the location indicator unit or the decoder activation unit.

The decoder activation unit in the addressable location indicator apparatus is composed of five functional units, they are: two decoder units, a central processing unit (CPU), and a transmitter and receiver (see FIG. 2). The first decoder unit is utilized to monitor incoming communications over a residential, commercial, or business telephone line, wireless network, fiber optic network, or other communication network. Such communications whether touch tones, digital, or analog information, are formatted in such a manner that the incoming information can be understood by the central processing unit (CPU). The formatted information from all incoming communications is then sent to the central processing unit (CPU) for analysis. Incoming communications are monitored by the central processing unit for activation events sent from authorized activators (so termed authorized activator events), or any other activation event that may be triggered remotely. The second decoder unit is utilized to monitor all outgoing communications over a residential, commercial, or business telephone line, wireless network, fiber optic network, or other communication network. Such communications whether touch tones, digital, or analog information, are formatted in such a manner that the incoming information can be understood by the central processing unit (CPU). The formatted information from all incoming communications is then sent to the central processing unit (CPU) for analysis. Outgoing communications are monitored by the central processing unit for 911 events, programmed number activation events, fire events, medical events, public safety events, or any other activation event that may be triggered locally. The receiver is utilized to monitor for incoming manual activation events from either the remote activation unit or decoder activation unit, and system readiness test results sent from the location indicator unit. Such information is then formatted and sent to the central processing unit (CPU) where it will undergo analysis. The function of the central processing unit (CPU) is to take in all the information sent to it by the decoder units and the receiver unit and apply a rules based system of decision making (algorithm) to determine if the addressable location indicator apparatus should be activated. If the addressable location indicator apparatus is activated by the central processing unit (CPU), the central processing unit will send out commands to the location indicator unit by means of the transmitter unit. Utilizing the rules based system, the central processing unit (CPU) will determine what type of event has occurred (medical event, fire event, public safety event, 911 event, authorized activator event, programmed number activation event, remote activation unit, manual activation event, etc.) and choose the proper blink and sonic events to be utilized by the location indicator unit. This information will be transmitted to the location indicator unit in a numeric data frame which will contain an activation command by means of the transmitter unit in the decoder activation unit.

The location indicator unit in the addressable location indicator apparatus is composed of seven functional units, they are: a receiver, a transmitter, a central processing unit (CPU), a light source, a driver for the light source, a sound source, and a driver for the sound source (see FIG. 4). The receiver in the location indicator unit is constantly listening for a transmission indicative of an activation event from either the decoder activation unit or the remote activation unit. When such a signal is received, the numeric data frame within the signal is analyzed. Both an address and a personal identification number (PIN) are embedded within the numeric data frame of every outgoing signal from a decoder activation unit and remote activation unit. If both the address and personal identification number in the location indicator unit are identical to that transmitted by the decoder activation unit or the remote activation unit, the location indicator unit in the addressable location indicator apparatus is activated. The activation command within the numeric data frame transmitted from the decoder activation unit or remote activation unit and received by the location indicator unit is examined by the central processing unit (CPU). Each activation command has embedded within it an activation code or codes which determine how the addressable location indicator apparatus will operate upon activation. From the information extracted in the activation command, both a sonic event and a blink event are chosen by the central processing unit (CPU) for the activation event that has just been triggered. Dependent upon the information contained in the activation command, certain light emitting sources (such as light bulbs, LED's, and other such devices known to those skilled in the art) will then be triggered to flash in a particular sequence and duty cycle and certain sounds will be triggered to be emitted from sound emitting sources (such as horns, speakers, and other such devices known to those skilled in the art). The light emitting sources utilized in the location indicator unit are controlled by their own driver circuits which enable them to flash in a manner controlled by the central processing unit (CPU) and dictated by the activation code embedded within the activation command. The sound emitting sources utilized in the location indicator unit are also controlled by their own driver circuits which enable them to emit sound in a manner controlled by the central processing unit (CPU) and dictated by the activation code embedded within the activation command. The central processing unit (CPU) within the location indicator unit also continually performs a system readiness test which checks for things such as burnt out light emitting sources and non functioning sound emitting sources, and integrity checks on the receiver transmitter systems. If any light or sound emitting source is non functioning within the location indicator unit, a signal is transmitted back to the decoder activation unit by means of the transmitter within the location indicator unit. In such an instance a visual indicator such as a LED or LCD located on the decoder activation unit will display the information pertaining to the failure within the location indicator unit. Additionally, should the location indicator unit undergo activation during an activation event, and should the chosen sonic event or blink event be unavailable due to a malfunction within the location indicator unit, the central processing unit (CPU) within the location indicator unit will choose an alternate sonic event or blink event to replace the event which is unavailable due to a failure in the location indicator unit.

The remote activation unit in the addressable location indicator apparatus is composed of three functional units, they are: the keypad, microprocessor, and transmitter (FIG. 7). In the preferred embodiment, the keypad consists of two buttons, one red to trigger a medical event or fire event, and one blue to trigger a public safety event. When either button is pushed the microprocessor generates a numeric data frame which contains an address, activation command, activation code, and personal identification number (PIN). The data frame containing this information is then transmitted out to both the location indicator unit and the decoder activation unit. If both the address and personal identification number in the location indicator unit are identical to that transmitted by the remote activation unit, an activation event is triggered in the addressable location indicator apparatus, and the location indicator unit is activated utilizing the sonic event and blink event specified in the activation code contained within the activation command sent via the numeric data frame transmitted from the remote activation unit. If both the address and personal identification number in the decoder activation unit are identical to that transmitted by the remote activation unit, an activation event is triggered in the addressable location indicator apparatus, and the decoder activation unit is activated and dials a set of preprogrammed telephone numbers unit over a residential, commercial, or business telephone line, wireless network, fiber optic network, or other communication network. The series of numbers dialed by the decoder activation unit will depend upon the activation code contained within the activation command sent by the remote activation unit.

In the preferred embodiment, the decoder activation unit is a table top unit shown in FIG. 3. The front of the unit consists of an LCD display unit (1), and keypad (14). Immediately below the LCD display unit are a series of indicator LED's including: a power on LED (9), a system ready LED (10), a location indicator unit ready LED (11), a light source #1 malfunction LED (12), and a light source #2 malfunction LED (13). To the right of the keypad (14) are three panic buttons which will activate the unit in any one of three modes. The buttons are from left to right across the face of the decoder activation unit: fire event panic button (6), medical event panic button (7), and public safety event panic button (8). Corresponding to each panic button is a lamp or LED which will emit light when an event has been triggered manually, remotely, or automatically. The lamps or LED's are from left to right across the face of the decoder activation unit: fire event lamp or LED (2), medical event lamp or LED (3), and public safety event lamp or LED (4). An antenna (5) protrudes from the top of the unit to enable the unit to function utilizing a wireless network or cellular telephone network. On the very top of the unit is a microphone (15) which can be remotely activated by an authorized activator to allow emergency personnel to hear what is going on within the residence that the location indicator apparatus was triggered from. From the rear of the unit are various connections which allow the decoder activation unit to communicate and function with the other functional units which comprise the addressable location indicator apparatus. Connections on the back of the unit include: a telephone input jack (16), a network connection jack (17), an optical network (or fiber optic) connection jack (18), a power in jack (19), a dip switch to set the address of the decoder activation unit (20), and a telephone output jack (21) to allow a residential, commercial, or business telephone to be connected to the decoder activation unit.

The location indicator unit in the preferred embodiment of the addressable location indicator apparatus is shown in the two most common variants in FIG. 5 and FIG. 6. FIG. 5 depicts the location indicator unit constructed in such a manner that it is to be utilized by being placed in an existing light bulb socket by means of connector (22) or plugged into any alternating current receptacle by mean of the plug (24) which folds down into the casing of the location indicator unit should the alternating current receptacle not be utilized as the power source for the location indicator unit. The location indicator unit depicted in FIG. 5 is tailored toward aftermarket addition of the addressable location indicator apparatus in preexisting structures, as this unit can be readily installed in any building or structure without the need to directly wire the location indicator unit to a power source. The principal components depicted in FIG. 5 of the after-market addition variant or the location indicator unit are: a connector designed for a typical light bulb socket (22), a dip switch (23) for setting the address of the location indicator unit for communication with the decoder activation unit and remote activation unit, a connector designed for an alternating current (AC) receptacle (24), two high intensity light emitting sources which may or may not emit colored light (typically from 40–1000 Watts by power, or by visible light output from 2,000 to 1,000,000 candle power) shown in (25) and (30), two transparent shields which may be colored depending upon the application shown in (26) and (29), an antenna (27) for wireless communication with the decoder activation unit and remote activation unit, a transparent dome (28) to enclose the light emitting sources (25) (30) and the wireless antenna (27), and a sound emitting source (31) which emits loud noise (typically from 75 to 140 dB) mounted on the exterior of the case of the location indicator unit.

FIG. 6 depicts the location indicator unit of the addressable location indicator apparatus in such a manner tailored for installation during construction of a new structure. FIG. 6 depicts this variant of the location indicator unit with its principal components spread out for visual clarity, the preferred embodiment of this variant features a more compact placement of components. This variant is directly wired to the power system of the building or structure to which it is installed. The principal components depicted in FIG. 6 of this variant of the location indicator unit are: an antenna (32) for wireless communication with the decoder activation unit and remote activation unit, two high intensity light emitting sources which may or may not emit colored light (typically from 40–1000 Watts by power, or by visible light output from 2,000 to 1,000,000 candle power ) shown in (33) and (35), a sound emitting source (34) which emits loud noise (typically from 75 to 140 dB), and a dip switch (36) utilized to set the address of the location indicator unit for communication with the decoder activation unit and remote activation unit. If the high intensity light emitting sources (33) and (35) do not emit colored light then colored transparent shields may be placed in front of them within this variation of the location indicator unit.

The remote activation unit in the preferred embodiment of the addressable location indicator apparatus has two common variants. The first variant, depicted in FIG. 8, is a portable remote activation unit designed to be attached to a key ring or other commonly carried implement. The principal components depicted in FIG. 8 of this variant of the remote activation unit are: an attachment mechanism (37), a LED (38), two buttons (39) and (41), and a dipswitch (40). The LED (38) emits light whenever an activation event is triggered by pressing buttons (39) or (41) on the remote activation unit. One button is utilized for triggering a medical event or fire event while the opposing button is utilized for triggering a public safety event. The dipswitch is utilized to set the address of remote activation unit for communication with the decoder activation unit and location indicator unit.

The second variant, depicted in FIG. 9, is a fixed remote activation unit designed to be mounted in a room within the residence in which the addressable location indicator apparatus is installed. The principal components depicted in FIG. 9 of this variant of the remote activation unit are: two buttons (42) and (43), a dipswitch (46), two light emitting devices (44) and (45), and a wireless antenna (47). Buttons (42) and (43) are utilized to trigger activation events in the addressable location indicator apparatus. One button is reserved for triggering a medical activation event or a fire activation event, while the other button is reserved for triggering a public safety activation event. When button (42) is pushed light emitting device (45) is activated until such time as the activation event triggered by the pushing of the button is cancelled or the unit is reset. When button (43) is pushed light emitting device (44) is activated until such time as the activation event triggered by the pushing of the button is cancelled or the unit is reset. The dipswitch (46) is utilized to set the address of remote activation unit for communication with the decoder activation unit and the location indicator unit. The antenna (47) provides this variant of the remote activation unit the ability to communicate with the decoder activation unit and the location indicator unit.

Both the decoder activation unit and the location indicator unit in the addressable location indicator apparatus have self contained backup power systems residing within their respective units. Should a power failure occur, or power be inadvertently or intentionally interrupted to either the location indicator unit or the decoder activation unit, the system will continue to function normally until the self contained backup power systems residing within the respective units are exhausted. These self contained backup power systems are recharged when the addressable location indicator apparatus is functioning normally and is connected to an uninterrupted power supply.

The addressable location indicator apparatus method is illustrated in FIG. 10 which shows the utilization of units within the addressable location indicator apparatus for specific activation events, and indicates which unit in the addressable location indicator apparatus triggers a specific activation event. The location indicator unit never triggers an activation event, but the location indicator unit is always utilized during any activation event in the addressable location indicator apparatus to produce blink events and sonic event for location indication purposes. The remote activation unit is never utilized in the system for 911 events (10-1), authorized activator events (10-2), or programmed number activation events (10-3). It is possible that the remote activation unit is the unit which triggers an activation event for a remote activation event (10-4), manual activation event(10-5), medical event (10-6), fire event(10-7), or public safety event (10-8). If the remote activation unit triggers a remote activation event (10-4), manual activation event(10-5), medical event (10-6), fire event(10-7), or public safety event (10-8), then the remote activation unit is utilized within the addressable location indicator apparatus during such an activation event. The decoder activation unit is always utilized in the addressable location indicator apparatus during any activation event. The decoder activation unit is always the triggering unit for 911 events (10-1), authorized activator events (10-2), or programmed number activation events (10-3). It is possible that the decoder activation unit is the unit which triggers an activation event for a remote activation event (10-4), manual activation event(10-5), medical event (10-6), fire event(10-7), or public safety event (10-8). The eight termed activation events shown in FIG. 10 are representative of the most common such activation events for the addressable location indicator apparatus, and one skilled in the art recognizes that such events could be termed differently yet not alter the functionality of the method herein disclosed.

Broadly speaking, in one aspect this invention concerns an addressable location indicator apparatus for indicating the street address of a residential, commercial, or business location, the apparatus comprising:

(a) a decoder activation unit which is connected to a residential, commercial, or business telephone line, wireless network, fiber optic network, or other communication network. The decoder activation unit monitors outgoing and incoming communications (or calls) and is capable of activating the location indicator unit in the addressable location indicator apparatus whenever an activation event occurs. The decoder activation unit is also capable of dialing a set of preprogrammed telephone numbers over a residential, commercial, or business telephone line, wireless network, fiber optic network, or other communication network whenever an activation event occurs.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

The decoder activation unit, location indicator unit, and remote activation unit together comprise the addressable location indicator apparatus, and communicate as a system to accomplish the addressable location indicator method.

In another aspect, the invention concerns an addressable location indicator apparatus for indicating the street address of a residential, commercial, or business location, which is activated locally by a 911 event. The apparatus comprising:

(a) a decoder activation unit which is connected to a residential, commercial, or business telephone line, wireless network, fiber optic network, or other communication network. The decoder activation unit monitors outgoing communications (or calls) and activates the location indicator unit of the addressable location indicator apparatus when a 911 event occurs on a residential, commercial, or business telephone line, wireless network, fiber optic network, or other communication network to which the decoder activation unit in the addressable location indicator apparatus is connected to.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

In another aspect, the invention concerns an addressable location indicator apparatus for indicating the street address of a residential, commercial, or business location, which is activated locally by a programmed number activation event. The apparatus comprising:

(a) a decoder activation unit which is connected to a residential, commercial, or business telephone line, wireless network, fiber optic network, or other communication network. The decoder activation unit monitors outgoing communications (or calls) and activates the location indicator unit of the addressable location indicator apparatus when a programmed number activation event occurs on a residential, commercial, or business telephone line, wireless network, fiber optic network, or other communication network to which the decoder activation unit in the addressable location indicator apparatus is connected to.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

In another aspect, the invention concerns an addressable location indicator apparatus for indicating the street address of a residential, commercial, or business location, which is activated remotely by an authorized activator. The apparatus comprising:

(a) a decoder activation unit which is connected to a residential, commercial, or business telephone line, wireless network, fiber optic network, or other communication network. The decoder activation unit monitors incoming communications (or calls) on a residential, commercial, or business telephone line, wireless network, fiber optic network, or other communication network and activates the location indicator unit of the addressable location indicator apparatus when an authorized activator triggers an activation event remotely over a residential, commercial, or business telephone line, wireless network, fiber optic network, or other communication network to which the decoder activation unit in the addressable location indicator apparatus is connected to. The identity of the authorized activator is confirmed by means of a personal identification (PIN) number and/or caller identification mechanism.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event which activates the location indicator unit of the addressable location indicator apparatus and activates the decoder activation unit of the addressable location indicator apparatus to dial a set of preprogrammed numbers depending upon the activation code within the activation command sent by the remote activation unit.

In another aspect, the invention concerns an addressable location indicator apparatus for indicating the street address of a residential, commercial, or business location, which is activated remotely by a remote activation unit. The apparatus comprising:

(a) a decoder activation unit which is connected to a residential, commercial, or business telephone line, wireless network, fiber optic network, or other communication network. The decoder activation unit monitors outgoing and incoming communications (or calls) and is capable of activating the location indicator unit in the addressable location indicator apparatus whenever an activation event occurs. The decoder activation unit is also capable of dialing a set of preprogrammed telephone numbers over a residential, commercial, or business telephone line, wireless network, fiber optic network, or other communication network whenever an activation event occurs.

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event. In the event of a remote activation event, the remote activation unit will activate the location indicator unit of the addressable location indicator apparatus and trigger the decoder activation unit of the addressable location indicator apparatus to dial a preprogrammed series of telephone numbers over a residential, commercial, or business telephone line, wireless network, fiber optic network, or other communication network. The numbers dialed will depend on the activation code within the activation command in the numeric data frame sent by the remote activation unit.

In another aspect, the invention concerns an addressable location indicator apparatus for indicating the street address of a residential, commercial, or business location, which is activated manually by means of some physical or electrical trigger on the remote activation unit or the decoder activation unit. The apparatus comprising:

(a) a decoder activation unit which is connected to a residential, commercial, or business telephone line, wireless network, fiber optic network, or other communication network. The decoder activation unit monitors outgoing and incoming communications (or calls) and is capable of activating the location indicator unit in the addressable location indicator apparatus whenever an activation event occurs. The decoder activation unit is also capable of dialing a set of preprogrammed telephone numbers over a residential, commercial, or business telephone line, wireless network, fiber optic network, or other communication network whenever an activation event occurs. The decoder activation unit is also capable of triggering an activation event manually by means of a physical trigger (such as a button on the unit) or by means of an electrical trigger (such as a sensor).

(b) a location indicator unit, which is capable of attracting attention by controlling light emitting sources (such as light bulbs, LED's, and other such devices known to those skilled in the art.) and sound emitting sources (such as horns, speakers, and other such devices known to those skilled in the art) which enable the location indicator unit to emit light and/or sound in such a fashion that attention is called to the location in which the location indicator unit in the addressable location indicator apparatus is installed.

(c) a remote activation unit, utilized for triggering an activation event. In the event of a remote activation event, the remote activation unit will activate the location indicator unit of the addressable location indicator apparatus and trigger the decoder activation unit of the addressable location indicator apparatus to dial a preprogrammed series of telephone numbers depending upon the activation code within the activation command sent by the remote activation unit over a residential, commercial, or business telephone line, wireless network, fiber optic network, or other communication network. The remote activation unit is capable of triggering an activation event manually by means of a physical trigger (such as a button on the unit) or by means of an electrical trigger (such as a sensor).

We claim:

1. An addressable location indicator apparatus and method capable of remote or local activation over a residential, commercial, or business telephone line, wireless network, fiber optic network, fiber optic cable, or other communication network, which draws attention to a particular residential, commercial, or business location by means of audio visual indicators, the apparatus comprising:

(a) a decoder activation unit, for determining when a 911 event, programmed number activation event, authorized activator event, remote activation event, local activation event, medical activation event, fire activation event, public safety activation event, or manual activation event is triggered;

(b) a location indicator unit, which activates the audio and visual location indicators when an activation event has occurred within the addressable location indicator apparatus;

(c) a remote activation unit, for remotely triggering an activation event in the addressable location indicator apparatus when a remote activation event or manual activation event occurs.

2. The apparatus of claim 1 further comprising a method for controlling light emitting sources (such as light bulbs, LED's, and other such devices known to those skilled in the art.) to enable the location indicator unit of the addressable location indicator apparatus to emit light in such a fashion that is irregular or abnormal when compared to normal steady state lighting (such as blinking or flashing coded mnemonics such as "SOS", or operating on an irregular duty cycle).

3. The apparatus of claim 1 further comprising a method for controlling sound emitting sources (such as horns, speakers, and other such devices known to those skilled in the art) to enable the location indicator unit of the addressable location indicator apparatus to emit sound in such a fashion that is distinctive (such as siren type noises or other types of sounds operating on a regular or irregular type of duty cycle).

4. The apparatus of claim 1 further comprising a method for determining when 911 (a 911 event) or any other numerical sequence programmed into the decoder activation units central processing unit is dialed (a programmed number activation event) from a residential, commercial, or business telephone line, wireless network, fiber optic network, or any other communications network to which the addressable location indicator apparatus is connected to.

5. The apparatus of claim 1 further comprising a method for remote activation of the addressable location indicator apparatus by an authorized activator utilizing a residential, commercial, or business telephone line, wireless network, fiber optic network, or any other communications network (termed a remote activation event).

6. The apparatus of claim 1 further comprising a method of manual activation (a manual activation event) of the location indicator unit in the addressable location indicator apparatus manually by means of the remote activation unit or decoder activation unit.

7. The apparatus of claim 1 further requiring a method of authentication such as a personal identification number or other confirmatory means to cancel an activation event.

8. The method of claim 5 further comprising a method of authentication of an authorized activator when an activation attempt is made remotely on the addressable location indicator apparatus over a residential, commercial, or business telephone line, wireless network, fiber optic network, or any other communications network.

9. The method of claim 8 further comprising a method of authentication by utilization of a personal identification number, device address, coding algorithm, and/or caller identification mechanism.

10. The method of claim 6 further comprising a method of automatically dialing a set of telephone numbers programmed into the central processing unit of the addressable location indicator apparatus over residential, commercial, or business telephone line, wireless network, or fiber optic network when a manual activation event occurs.

11. The apparatus of claim 1 further comprising a method for triggering a medical activation event, fire activation event, or public safety activation event by means of a physical trigger (such as a button on the unit) or by means of an electrical trigger (such as a sensor).

12. The method of claim 11 comprising a method of automatically dialing a set of telephone numbers programmed into the central processing unit of the addressable location indicator apparatus over residential, commercial, or business telephone line, wireless network, or fiber optic network when a medical activation event, fire activation event, or public safety activation event occurs.

13. The apparatus of claim 1 further comprising a method for remote activation of the addressable location indicator apparatus by means of a remote activation unit.

14. The apparatus of claim 1 further comprising a method for the utilization of alternate power sources in the event of power interruption to the addressable location indicator apparatus by means of an alternate power source accessible to the decoder activation units, location indicator units, and remote activation units in the addressable location indicator apparatus.

15. The apparatus of claim 1 further comprising a method for remote activation of the addressable location indicator apparatus.

16. The apparatus of claim 1 further comprising a method for local activation of the addressable location indicator apparatus.

17. The apparatus of claim 1 further comprising a method for conducting system readiness checks or diagnostic tests on the integrity of the addressable location indicator apparatus and having the ability to communicate the results of such tests by audio and/or visual means.

18. The method of claim 17 further comprising a method of automatically changing sonic events and/or blink events for an activation event should the preferred sonic event or blink event be unavailable due to a malfunction within the addressable location indicator apparatus.

* * * * *